US008579020B2

(12) United States Patent
Catelli et al.

(10) Patent No.: US 8,579,020 B2
(45) Date of Patent: Nov. 12, 2013

(54) HEAT EXCHANGER WITH CONCENTRIC TUBES

(75) Inventors: Roberto Catelli, Parma (IT); Luca Belletti, Reggio Emilia (IT)

(73) Assignee: CFT S.p.A., Parma (IT)

( * ) Notice: Subject to any disclaimer, the term of this patent is extended or adjusted under 35 U.S.C. 154(b) by 1007 days.

(21) Appl. No.: 12/634,209

(22) Filed: Dec. 9, 2009

(65) Prior Publication Data

US 2011/0030933 A1 Feb. 10, 2011

(30) Foreign Application Priority Data

Aug. 7, 2009 (EP) ..... 09425322

(51) Int. Cl.
*F28D 7/12* (2006.01)

(52) U.S. Cl.
USPC ..... 165/142

(58) Field of Classification Search
USPC ..... 165/142, 143, 154
See application file for complete search history.

(56) References Cited

U.S. PATENT DOCUMENTS 2,243,593 A * 5/1941 Zallea ..... 165/142
2,267,695 A * 12/1941 Graham ..... 165/142
2,299,307 A * 10/1942 Cornell ..... 508/110
4,718,483 A * 1/1988 Artusi ..... 165/142
5,542,467 A * 8/1996 Carpentier ..... 165/70
7,368,139 B1 5/2008 Bronnert

FOREIGN PATENT DOCUMENTS

DE 102005053609 A1 5/2007
WO 0159385 A 8/2001

* cited by examiner

*Primary Examiner* — Brandon M Rosati
(74) *Attorney, Agent, or Firm* — Pearne & Gordon LLP

(57) ABSTRACT

The invention relates to an improved concentric tube heat exchanger. The exchanger comprises a cylindrical tube (1) for circulation of a product provided with a flanged inlet (11) and a flanged outlet (12) of the product; a hollow body (2) concentric internally of the tube (1), in which the exchange fluid circulates, defining internally thereof preferential pathways for an outward and a return run of the exchange fluid and having the inlet and the outlet of the exchange fluid arranged at a same end of and in proximity of an end of the tube; a flanged inlet connector (3) for introducing the product into the tube (1), a flange (3*a*) of which connects with an inlet flange (11*a*) of the inlet (11) of the tube; a flanged outlet connector (4) for extracting the product from the tube (1), a flange (4*a*) of which connects with a flange (12*a*) of the outlet (12) of the tube; an intermediate flange (5), connected to the end of the hollow body exhibiting the inlet and outlet of the fluid and projecting from the tube (1), which is provided with a passage hole (5*c*) for the product to be treated and with an inlet mouth (5*a*) and an outlet mouth (5*b*) for the exchange fluid connected respectively to the outward and return pathway of the exchange fluid; the passage hole (5*c*), inlet mouth (5*a*) and outlet mouth (5*b*) not being in reciprocal connection.

8 Claims, 2 Drawing Sheets

HEAT EXCHANGER WITH CONCENTRIC TUBES

FIELD AND BACKGROUND OF THE INVENTION

The invention relates to a heat exchanger having improved concentric tubes. Reference is made in particular to heat exchangers used for heating or cooling treatment of fluid food products, either containing solid pieces or not but in any case being liable to pumping, in which the product to be treated circulates in long cylindrical tubes externally of which a heating/cooling covering is provided in which heating or cooling fluid circulates, commonly known as the exchange fluid. The exchange fluid is generally heated water or coolant water. In these kinds of exchangers a hollow axial body is provided internally of the tubes in which the product circulates, in which hollow axial body the exchange fluid is introduced. This hollow body is normally configured such as to define preferential pathways, respectively for the outward and return runs of the exchange fluid, and such as to have the inlet and outlet of the exchange fluid arranged at a same end of the hollow body, while the other end of the body is closed. In general terms, in this type of exchanger the product to be treated circulates in an annular-section cavity defined between the internal wall of the cylindrical tube for product circulation and the external wall of the hollow body arranged internally of the tube. A covering is arranged externally of the circulation tube, such that the product receives or relinquishes heat both from the outside of the tube and from the inside of the tube.

In order to prevent excessive length of the tubes in which the product circulates, the heat exchangers, as can be seen in FIG. 1, are normally constituted by various straight portions, arranged in series, which are crossed by the product which enters the first portion, exits therefrom in order to enter the next, and so on up until it exits from the final portion; these portions however can each reach several meters in length. An inlet connection for the product into the heat is provided, arranged at the start of the first portion of the heat exchanger itself. Intermediate connectors are provided between the various portions of the heat exchanger and are generally U-shaped as the heat exchanger portions are kept parallel to one another and the connectors carry the product to be treated from one portion to the next. These intermediate connectors are provided with flanges which enable the connection to corresponding flanges on the product circulation tubes. Annular seals are provided between the flanges, which guarantee sealing of the connections. Naturally in the infrequent case that the heater had only one portion, U-connectors would not be necessary (realising the outlet connection of the tube of one portion and the inlet connection of the next) but there would instead be an inlet connector and an outlet connector for the product joined to the ends of the cylindrical tube.

The exchange fluid circulating in the various external coverings is inserted in the various coverings, and passes from one mantle to another unproblematically as the external structure of the coverings has no involvement with the trajectory of the product. More complex is the introduction and extraction of the exchange fluid into and from the various hollow bodies present in the tubes crossed by the product, as the structure of the hollow bodies is completely internal of the product flow and the tubes carrying exchange fluid into the hollow bodies have to cross the product flow.

To solve the problem the known-type exchangers prolongs the central hollow body up to bringing it to exit the pathway of the product to be treated; the exit of the prolongation is generally from the intermediate connectors. In this way the exchange fluid can be introduced and extracted into and from the hollow central body without the fluid interfering with the product flow. Naturally the zone of interference between the prolongation of the hollow body and the wall of the intermediate connector must be completely sealed such as to prevent the leaking of the product. This is obtained very simply by making a hole in the connector wall, into which the prolongation of the intermediate hollow body is passed, and by welding the external wall of the prolongation to the peripheral edge of the hole made in the connector.

The known solution exhibits some drawbacks. During the stage of construction it is not very easy to perform the welding between the prolongation of the hollow body and the connector wall correctly as the internal part of the connector is not easily reachable. During the functioning of the heater the product frequently stagnates at dead points in the contact zone between the prolongation of the hollow body and the connector wall; this necessitates frequent cleaning operations of the product pathway, operations which would be much less frequent if the product could circulate freely and if there were not stagnation-prone zones. Further, when it becomes necessary to replace the seals ensuring the seal between the flanges, which has to be done rather frequently, the hollow body, which is welded in a single piece with the connector, has to be completely extracted from the cylindrical tube such as to be able to insert the annular seal from the free side of the hollow body, which is at the opposite end to the end projecting from the connector, or such as to be able to insert the seal in the flange connected to the cylindrical tube. Both the cleaning and replacing operations of the seals lead to a removal of the hollow body from the cylindrical tube. As the hollow body exhibits supports which enable the coaxiality with the tube it is inserted in to be maintained, this removal can lead to a scoring of the inside of the cylindrical tube. Finally, as the U-connectors connect up two portions of the heat exchanger, in order to perform the cleaning and replacing operations of the seals in one alone of the portions, it is necessary to remove the hollow bodies of both portions of the heater and connected by the U-connector from the respective cylindrical tubes.

SUMMARY OF THE INVENTION

The aim of the present invention is to obviate the above-indicated drawbacks by providing a heat exchanger which is simple to construct, clean, mount and demount in order to perform the necessary maintenance. An advantage of the invention is that it enables a rapid, simple and secure fastening of the elements that make it up.

A further advantage of the invention is to reduce the number of cleaning operations inside the tubes and connectors in which the product to be treated circulates.

These aims and advantages and more besides are all attained by the invention as it is characterised in the accompanying claims.

BRIEF DESCRIPTION OF THE DRAWINGS

Further characteristics and advantages of the present invention will better emerge from the detailed description that follows of an embodiment of the invention, illustrated by way of non-limiting example in the accompanying figures of the drawings, in which.

DETAILED DESCRIPTION OF PREFERRED EMBODIMENTS OF THE INVENTION

Figure 1:
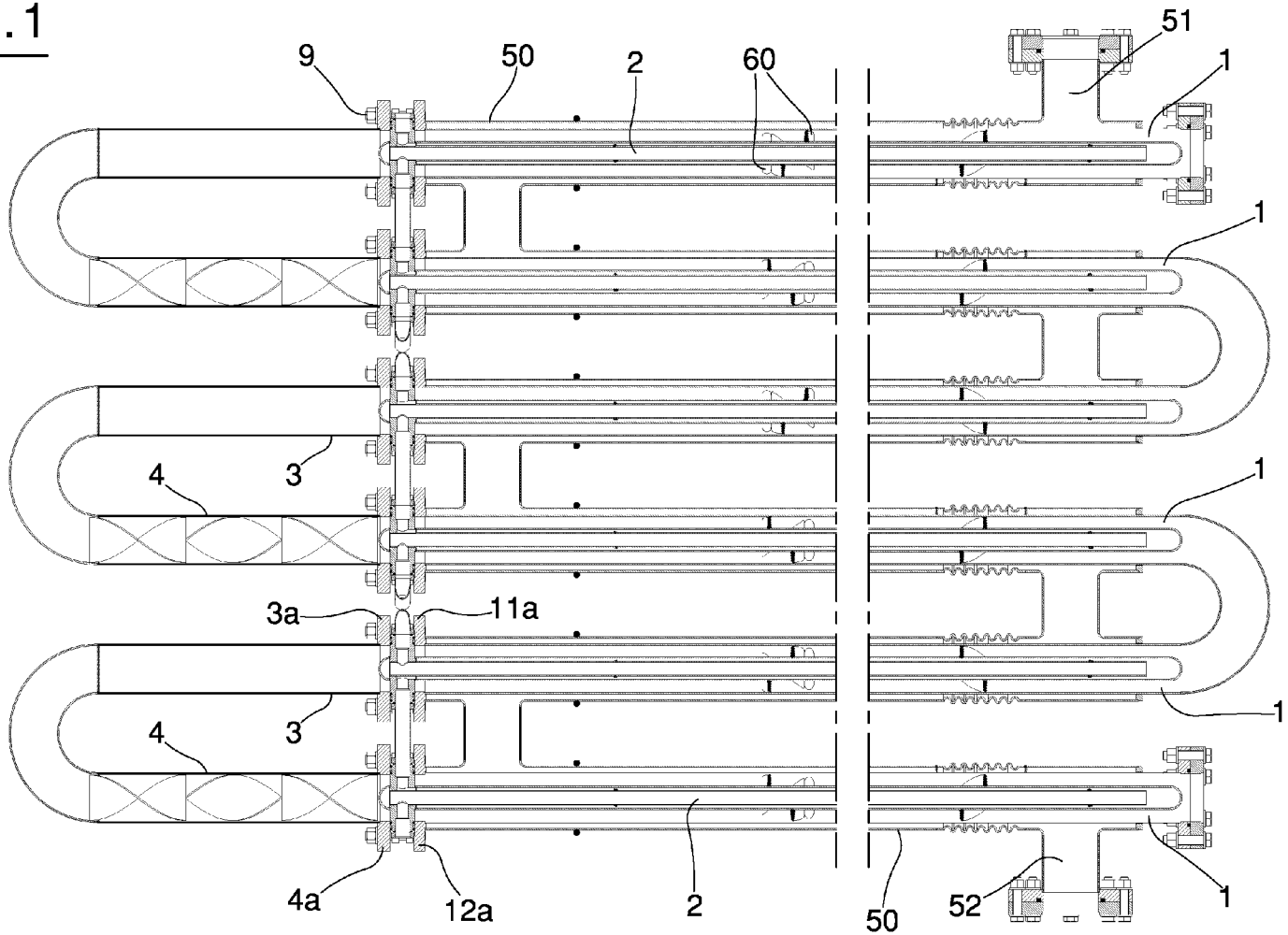
FIG. 1 is a vertical elevation of a multi-portion exchanger of the invention.
Figure 2:
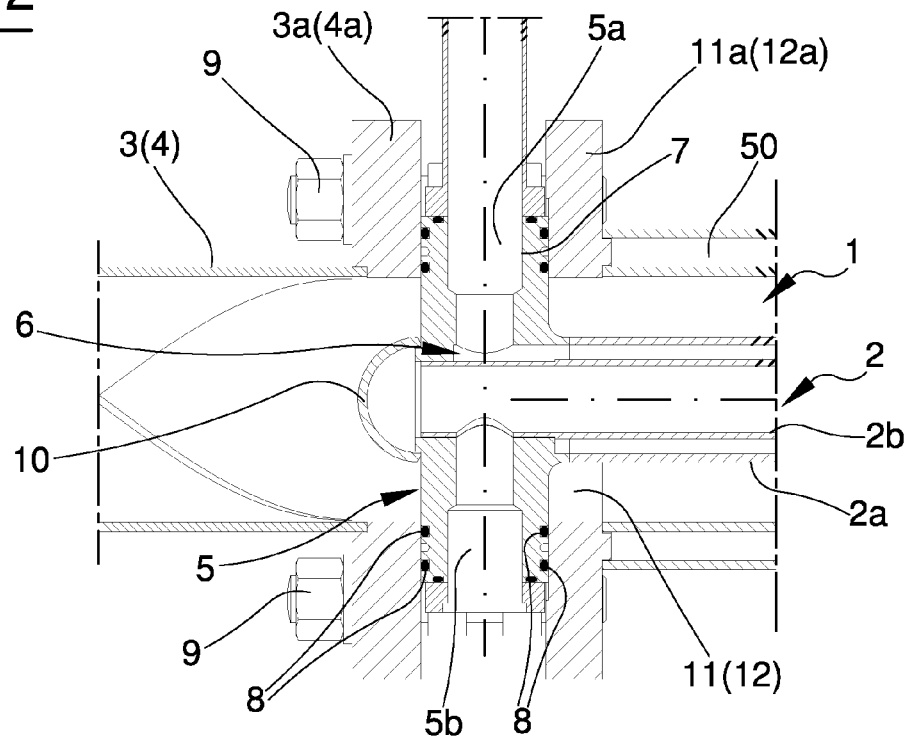
FIG. 2 is a section of a connecting zone, either inlet or outlet, between the cylindrical tube, the connector and the central hollow body of an exchanger of the invention.
Figure 3:
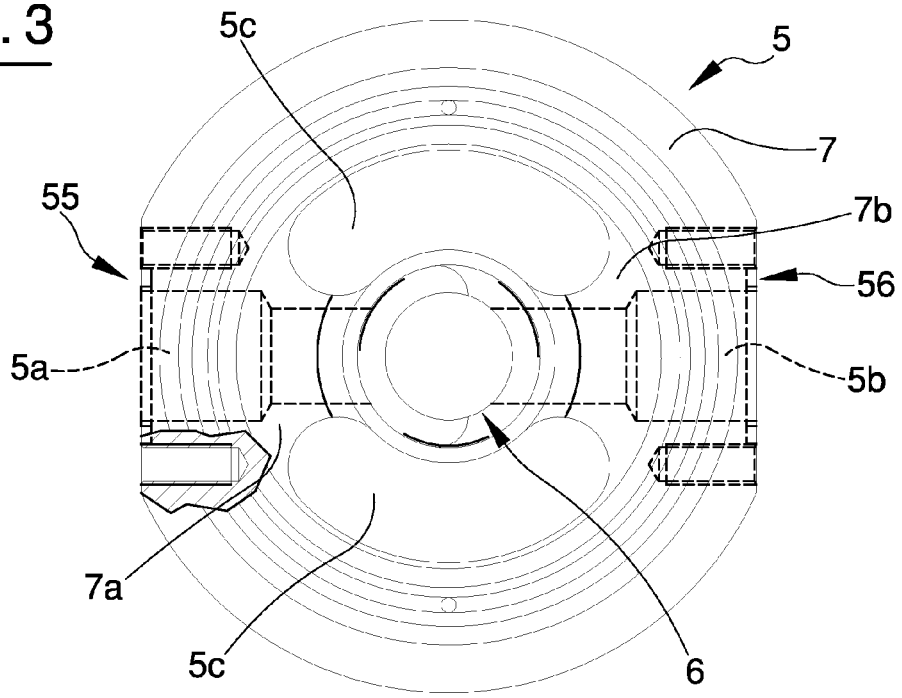
FIG. 3 is a front view of an intermediate flange of the exchanger of the invention.

The exchanger is of a type comprising a cylindrical tube 1 for circulation of the product, which is provided with a flanged inlet 11 and a flanged outlet 12 of the product. The inlet is provided with a flange 11*a* and the outlet is provided with a flange 12*a*. The flanges are solidly connected to the respective ends of the tube, for example by welding. The exchanger exhibits a flanged inlet connector 3, for introducing the product into the tube 1, and a flanged outlet connector 4 for extracting the product from the tube 1. Both the inlet connector and the outlet connector are provided with flanges, respectively 3*a* and 4*a*, which connect respectively with the flange 11*a* of the inlet 11 of the tube and with the flange 12*a* of the outlet 12 of the tube.

As in these exchangers the tube in which the product to be treated circulates has to be of considerable length, in order to prevent having a single tube which is too long, these exchangers, as can be seen in FIG. 1, are normally constituted by various straight portions, arranged in series, which are crossed by the product which enters the first portion, exits the first portion in order to enter the second, and so on until the product exits from the final portion. These portions can each be a few meters long. In this case, between the various portions of the exchanger, intermediate connections are provided, generally U-shaped, which function as outlet connectors for a tube and inlet connectors for the next tube. The following relates both to inlet connectors and outlet connectors realised as independent organs, both made in a U-shape and having similar forms, for example hollow toroidal or hollow cylindrical and connected to one another at a 90° angle.

In this type of exchanger, a hollow body 2 is provided which is arranged concentrically internally of the tube 1; heating fluid circulates internally of the hollow body, generally constituted by a cylindrical tube. The hollow body is configured such that internally thereof obligatory pathways are defined, respectively for the outward and return flow of the exchange fluid. The inlet and the outlet of the exchange fluid are also arranged at a same end and in proximity of an end of the tube 1. Normally this configuration is obtained, as illustrated in the figures, by realising the hollow body with two concentric tubes, of which the external tube 2*a* is open at an end and closed at the other, while the internal tube 2*b* exhibits an open end at the closed end of the external tube and the other end, also open, which exits from the open end of the external tube. In this way the exchange fluid flows into the crown defined between the external tube and the internal tube up to reaching the closed end of the external tube, enters the internal tube and is exits from the hollow body through the end of the tube that projects from the open end of the external tube; naturally the flow of exchange fluid can also be in the opposite direction.

A heating/cooling covering 50 is also provided in these exchangers, which envelops the tube 1 (more than one covering can be used to cover each tube 1 in the case of exchangers having more than one portion), in which the exchange fluid flows; this covering is normally welded to the outside of the tube 1 and is provided with inlet mouths 51 and outlet mouths 52 of the exchange fluid. In these exchangers, the product receives or relinquishes heat both from the outside of the tube, from the fluid circulating in the covering, and from the inside of the tube, from the fluid which circulates in the hollow body; the fluid used in these exchangers is normally water.

The above is part of the known art in the construction of this type of exchanger.

In the exchanger of the invention, each end of the hollow body is provided with an inlet and an outlet for the fluid, an intermediate flange 5 which is solidly connected, normally by welding, to the hollow body which projects from the tube 1.

The flange 5 is provided with a passage hole 5*c* for the product to be treated; the flange is further provided with an inlet mouth 5*a* and an outlet mouth 5*b* for the exchange fluid, which are connected respectively to the outward flow and the return flow of the exchange fluid. The passage hole 5*c*, inlet mouth 5*a* and outlet mouth 5*b* are not connected to one another.

The intermediate flange 5 exhibits a central hub 6 which is subdivided into two zones, separate from one another, which are respectively connected to the outward run of the exchange fluid, i.e. the tube external of the hollow body, and to the return run of the exchange fluid, i.e. the tube internal of the hollow body. The central hub 6 is connected to an external crown 7, the is internal diameter of which is equal to the internal diameter of the tube 1, by mean of two spokes 7*a* and 7*b*.

The inlet mouth 5*a* and the outlet mouth 5*b* for the exchange fluid are respectively afforded internally of each spoke 7*a*, 7*b*; these mouths are constituted by radial holes which open, respectively, internally of the external tube and the internal tube of the hollow body. The external surfaces of the two spokes 7*a*, 7*b* which come into contact with the flow of the product to be treated are tapered and rounded.

The passage 5*c* for the product to be treated is afforded in through-slots which cross the intermediate flange in an axial direction and which are delimited by the central hub 6, the external crown 7 and the spokes 7*a* and 7*b*; the shape of these elements defines two of the slots which have a bean-shaped section.

The central hub 6 is closed on the opposite side to the side facing the inside of the tube 1, by an ogive cover 10 which prevents exit of the exchange fluid from the internal tube of the hollow body towards the path of the product to be treated. The ogive shape of the cover, together with the tapered and rounded shape of the spokes, offers a low resistance to the fluid flow, prevents onset of excessive turbulence and does not lead to dead times, thus preventing the product from stagnating.

At least an annular cavity is afforded on each of the lateral surfaces of the external crown 7, which annular cavity is arranged in proximity of the internal diameter of the crown 7, i.e. in the immediate vicinity of the internal surface of the tube 1, the annular cavity being destined to receive a seal ring 8; for aseptic applications, as in the embodiment illustrated in the figures, two concentric annular cavities are afforded on each of the lateral surfaces of the external crown 7, a first of the cavities being arranged in is proximity of the internal diameter of the external crown and the second of the cavities being arranged at a radial distance from the first cavity which is equal to about double the width of each cavity, all destined to receive seal rings. The concentric double seals guarantee, as will be more fully explained herein below, a greater seal and enable, between the grooves containing the seals, a further annular groove to be afforded in which an aseptic fluid can circulate (a conformation known as an aseptic barrier). To contain the seal rings, a possible solution is also an open groove, i.e. a groove located directly on the internal edge of the flange, which enables the seal to face the product.

The radial thickness of the external crown 7, and therefore the external diameter of the intermediate flange, is kept to a minimum necessary for containing the annular cavity and ensuring the mechanical resistance of the crown. In other words, for the reason which will be better explained herein below, it is desired that the external diameter of the intermediate flange is as little as possible greater than the diameter of the seal rings.

Two flat areas 55, 56 are fashioned on the lateral surface of the intermediate flange and at the inlet mouth 5*a* and the outlet mouth 5*b*, which flat areas 55, 56 are parallel to one another. The flat areas 55, 56 enable easy connection of the inlet mouth 5*a* and the outlet mouth 5*b* to delivery and discharge tubes of the exchange fluid, and enable a smaller radial width of the intermediate flange.

In a preferred embodiment of the exchanger of the invention, the flanges of the connectors connect to the flanges of the tube 1 by means of four through-bolts 9 which lock the flanges to one another and which are arranged at the corners of a square. The intermediate flange 5, which is fastened between the above-mentioned flanges and which, thanks to the presence of the seal rings ensures the connecting seal between the connectors and the tube 1, has a diameter of such dimensions that it is contained internally of the ideal perimeter of the square at the corners of which the bolts 9 are arranged: this enables having an intermediate flange of extremely small radial dimensions and in any case much smaller than the radial dimensions of the flanges both of the connectors and the tube 1. More in general, n (e.g. 6 or 8) bolts can be arranged at corners of a polygon internally of which ideal perimeter the external diameter of the intermediate flange can be contained.

In exchangers of this type both the tube 1 and the hollow body 2 are, as mentioned, rather long (up to 5-6 meters); in order to maintain the hollow body concentric inside the tube 1, tabs 60 are provided, solidly connected to the external wall of the hollow body, which prevent radial movements of the hollow body internally of the tube and generate turbulence internally of the tube in order to improve the heat exchange coefficient. These tabs exhibit, for reasons that will be more fully explained herein below, a profile without edges.

The construction of the heat exchanger of the invention is extremely simple as all the zones which require welding are easily accessible.

The mounting of the exchanger is very simple and will be described with reference to a single connecting zone in which there are the inlet and outlet of the fluid into and from the hollow body; all the other connecting zones of this type are identical.

The central body with the intermediate flange connected at an end thereof to is inserted, from the other end, internally of the tube 1 up to when the intermediate flange comes into contact with the flange of the tube. The fact that the tabs 60 of the hollow body exhibit a profile lacking in edges prevents or at least strongly limits the possibility of scoring on the internal surface of the tube 1.

The inlet (or outlet) connector of the product is then neared to the intermediate flange and the two are fastened together by bolts 9, the two flanges of the connector and the tube embracing the intermediate flange, the seal rings of which ensure the connecting seal. The exchange fluid delivery and discharge conduits are then connected to the inlet and outlet mouths of the intermediate flange; also, the delivery and discharge conduits of the exchange fluid are connected to the inlet mouth and the outlet mouth of the external heating covering. Note that in the case of a multi-portion exchanger, the connecting zones in which the inlet and outlet of the fluid in the hollow body are present will all be located on a same side and the outlet connectors from a portion and the inlet connectors of a successive portion will have the typical U-shape.

The conformation of the exchanger of the invention, which does not exhibit dead points in which the product to be treated can stagnate, enables the exchanger to function for long periods without there being any need to perform frequent cleaning operations, which is something that occurs with exchangers of known type.

The conformation of the present exchanger is especially functional when it is necessary to perform the rather frequent operation of replacing the seal rings. To perform this replacement it is sufficient to disconnect the exchange fluid delivery and discharge conduits from the inlet and outlet mouths of the intermediate flange, and disconnect the connector and tube flanges by unscrewing the bolts 9, thus freeing the intermediate flange. By slightly moving the intermediate flange, i.e. of the hollow body, towards the outside the intermediate flange is freed from the flange of the tube (the opposite wall is already free after the detachment of the connector), creating a small space between the intermediate flange and the tube flange. Given the limited difference between the external diameter of the is intermediate flange and the diameter of the seal rings it is possible, by exploiting the natural elasticity of the seal rings, to slightly widen the seal rings and pass them onto the intermediate flange, then positioning them in the wall of the flange connected to the hollow body. There is no need to completely extract the hollow body from the tube 1, as is necessary with known exchangers in order to be able to insert the seal rings from the free end of the hollow body. Apart from making seal ring replacement very much faster and easier, this prevents possible scoring which can be caused notwithstanding the edgeless profile of the tabs 60 which strongly reduces that possibility anyway, following the moving of the hollow body from the tube. With exchangers having various portions connected in series, the complete independence of the hollow body with the intermediate flange of each portion, obtained by the detachment of the intermediate flange of the delivery and discharge conduits of the connecting flange, enables any operation to be performed on a portion without having to do anything to the portion connected thereto.

The invention claimed is:

1. An improved concentric tube heat exchanger, comprising: at least a cylindrical tube (1) for circulation of a product to be treated, provided with a flanged inlet (11) and a flanged outlet (12) of the product; a hollow body (2) internally of which an exchange service fluid circulates, the hollow body being arranged concentrically internally of the tube (1) and configured such as to define internally thereof compulsory pathways respective for an outward and a return run of the exchange service fluid and such as to have the inlet and the outlet of the exchange service fluid arranged at a same end of and in proximity of an end of the tube; a flanged inlet connector (3) for introducing the product into the tube (1), a flange (3*a*) of which the inlet connector (3) connects with an inlet flange (11*a*) of the inlet (11) of the tube; a flanged outlet connector (4) for extracting the product from the tube (1), a flange (4*a*) of the outlet connector (4) connects with a flange (12*a*) of the outlet (12) of the tube; an intermediate flange (5), said intermediate flange (5):

being solidly connected to the end of the hollow body provided with the inlet and the outlet for the exchange service fluid;

projecting from the tube (1);

being, provided with a passage hole (5*c*) for the product to be treated and with an inlet mouth (5*a*) and an outlet mouth (5*b*) for the exchange service fluid, respectively connected to the outward and return pathway of the exchange service fluid; the passage hole (5*c*), inlet mouth (5*a*) and outlet mouth (5*b*) not being in reciprocal connection;

the passage (5*c*) for the product to be treated crossing the intermediate flange (5) in the axial direction of the tube (1);

the flange of the inlet connector (3) and the inlet flange (11*a*) of the inlet (11) of the tube in combination embracing the intermediate flange (5) between them; or the flange (4*a*) of the outlet connector (4) and the flange (12*a*) of the outlet (12) of the tube in combination embracing the intermediate flange (5) between them.

2. The exchanger of claim 1, wherein the intermediate flange (5) exhibits a central hub (6) subdivided into two zones, separate from one another and respectively connected to the outward and return pathway of the exchange service fluid; the central hub (6) is connected to an external crown (7) an internal diameter of which is equal to an internal diameter of the tube (1), by means of two spokes (7*a*, 7*b*) internally of which the inlet mouth (5*a*) and the outlet mouth (5*b*) for the exchange service fluid are afforded; the passage hole (5*c*) is afforded in through-slots delimited by the central hub (6), the external crown (7) and the spokes (7, 7*b*).

3. The exchanger of claim 2, wherein at least an annular cavity is afforded on each of lateral surfaces of the external crown (7), which cavity is arranged in proximity of an internal diameter of the external crown (7) and is destined to house a seal ring (8); a radial thickness of the external crown (7) is kept to a minimum necessary for containing the annular cavity and ensuring mechanical resistance of the crown.

4. The exchanger of claim 2, wherein at least two concentric annular cavities are afforded on each of lateral surfaces of the external crown (7), a first of which cavities is arranged in proximity of an internal diameter of the external crown (7), and a second of which is located at a radial distance from the first cavity which is twice a width of each cavity, each of which cavities is destined to house a seal ring (8); a radial thickness of the external crown (7) is kept to a minimum necessary for containing the annular cavities and ensuring mechanical resistance of the crown.

5. The exchanger of claim 2, wherein: the central hub (6) is closed on an opposite side to a side facing towards inside the tube (1), by an ogive cover (10); external surfaces of the two spokes (7*a*, 7*b*) that come into contact with a flow of the product to be treated being tapered and rounded.

6. The exchanger of claim 1, wherein two reciprocally-parallel flat areas (55, 56) are fashioned on a lateral surface of the intermediate flange and at the inlet mouth (5*a*) and the outlet mouth (5*b*).

7. The exchanger of claim 1, wherein the flanges of the connectors connect with the flanges of the tube by means of through-bolts (9) which fasten the flanges together and which are arranged at corners of a polygon, wherein the intermediate flange (5) has a diameter of such dimensions as to be contained internally of an ideal perimeter of the polygon at corners of which the bolts (9) are located.

8. The exchanger of claim 1, wherein the hollow body (2) is maintained in a concentric position internally of the tube (1) by means of tabs (60), solidly connected to an external wall of the hollow body and exhibiting a profile lacking in edges.

* * * * *